US005467978A

United States Patent [19]

Paluch

[11] Patent Number: 5,467,978

[45] Date of Patent: Nov. 21, 1995

[54] TRAINING DEVICE FOR BASEBALL BATTING

[76] Inventor: Joseph J. Paluch, 2403 Carlanne Pl., Mississauga, Ontario, Canada, L5C 3H5

[21] Appl. No.: 282,558

[22] Filed: Jul. 29, 1994

[51] Int. Cl.[6] ..... A63B 69/40

[52] U.S. Cl. ..... 273/26 E; 273/413; 273/58 C

[58] Field of Search ..... 273/413, 26 R, 273/58 C, 26 E, 29 A

[56] References Cited

U.S. PATENT DOCUMENTS

| | | | |
|---|---|---|---|
| 2,017,720 | 10/1935 | Lake . | |
| 2,496,795 | 2/1950 | Johnson | 273/413 |
| 2,506,825 | 5/1950 | Carlson | 273/413 |
| 3,301,556 | 1/1967 | Hamilton et al. . | |
| 3,397,885 | 8/1968 | Nash . | |
| 3,649,018 | 3/1972 | Beam . | |
| 3,767,198 | 10/1973 | Boyer . | |
| 4,342,459 | 8/1982 | Pretorius . | |
| 4,573,679 | 3/1986 | Janszen . | |
| 4,706,964 | 11/1987 | Genovese | 273/413 |
| 4,793,612 | 12/1988 | Hammond . | |
| 4,881,742 | 11/1989 | Hargraves | 273/413 |
| 4,898,358 | 2/1990 | Love . | |
| 5,056,781 | 10/1991 | Preston et al. . | |
| 5,072,937 | 12/1991 | Zarate . | |

FOREIGN PATENT DOCUMENTS

| | | | |
|---|---|---|---|
| 1644988 | 4/1991 | U.S.S.R. | 273/413 |

*Primary Examiner*—Theatrice Brown
*Attorney, Agent, or Firm*—Lynn C. Schumacher

[57] ABSTRACT

There is disclosed a baseball batting training device provided with a base plate which is anchored to the ground by spikes, cork-shaped ground engaging pins or various other types of ground anchoring systems. A vertically extending hollow tube is mounted to a plate spaced from the base by rubber isolators. An L-shaped tube has one arm inserted in the vertical hollow tube with a rubber collar affixed about the inner tube. The vertical tube is provided with several vertically spaced pairs of holes for receiving a pin therethrough for adjusting the height of the horizontal arm of the tube. A ball is mounted to a flexible support arm which in turn is inserted into the end of the horizontal arm which is attached to a rubber joint. The flexible support arm and other rubber components provide damping of torque forces generated when the ball is batted thereby preventing the base from being dislodged from the ground.

7 Claims, 4 Drawing Sheets

TRAINING DEVICE FOR BASEBALL BATTING

FIELD OF THE INVENTION

The present invention relates to a portable training device for baseball batting.

BACKGROUND OF THE INVENTION

In the game of baseball the development of batting skills is an integral part, of the training regime for players. There are several different types of baseball training devices for developing batting skills. One type employs an automated ball thrower spaced from the batter that projects baseballs in the direction of the batter. Other types include a ball tethered at one end of a string or rope with the other end of the rope secured to a mechanism intended to move the ball to simulate pitching. U.S. Pat. No. 4,573,679 discloses such a device wherein water propulsion is used to propel the tethered ball in a circle. This device is messy due to water accumulating in addition to which the spray will disrupt the batter's concentration. U.S. Pat. No. 2,017,720 discloses a batting practise device having rotatable member at an obtuse angle which can be swivelled in a horizontal plane.

U.S. Pat. No. 5,056,781 discloses a tethered pitching device comprising a vertical upright attached at the bottom thereof to ground penetrating teeth. A pitcher pitches the ball and when hit by a batter the ball is constrained by the tethering. U.S. Pat. No. 3,767,198 discloses a batting practise device comprising a ball tethered to one end of a chord and the other end to one end of an elastic chord. The other end of the elastic chord is secured to a ground penetrating stake. A pitcher pulls on the ball to develop tension so that when the ball is released it is projected toward the batter. A drawback to these devices is the need for a pitcher to be present.

U.S. Pat. No. 3,397,885 discloses a training device with a ball tethered to an L-shaped supporting structure having a vertical stake which is driven into the ground. The ball is releasably attached to a chord using by means of a magnetic coupling so that when the ball is hit it is decoupled from the L-shaped supporting structure. U.S. Pat. No. 4,342,459 discloses a ball batting game comprising a tethered ball held at the end of a chord with the other end of the chord slidably attached to a flexible transverse cable suspended between two posts. When the ball is hit it travels along the horizontal cable between the posts.

U.S. Pat. No. 4,793,612 discloses an apparatus for practising and teaching ball batting comprising a ball tethered to one end of a cable with the other end attached to a rotary member mounted on a shaft. The shaft is secured to a vertical post which is cemented into the ground.

A drawback to many of the foregoing devices is that very high torques are imparted to the support structure by the batter hitting the ball. Consequently, the stakes used to anchor the devices to the ground tend to pull up with the result that the devices must be constantly re-anchored into the ground or permanently cemented into the ground.

U.S. Pat. No. 3,301,556 discloses a ball holding device for batting practise comprising a ball tethered to one end of a long rope with the other end of the rope anchored to the ground. The tethered ball is supported on a supporting frame anchored into the ground. Every time the ball is hit it must be retrieved and the ball remounted on the support frame.

Accordingly, it would be advantageous to provide a baseball batting training device which is both portable and which can be securely anchored to the ground in which torque generated by hitting the tethered ball are damped rather than transmitted to the ground anchor.

SUMMARY OF THE INVENTION

The subject invention provides a batting practise device for baseball batting which is portable, lightweight and self-supporting. The training device is useful for development of proper "eye-baseball" coordination and hitting mechanics.

The batting practise device comprises a base portion and a first support member attached thereto with the base portion being adapted to be anchored to a surface. The device includes second support member engaging with the first support member with the second support member being movable with respect to the first support member to a plurality of positions for adjusting the distance of the second support member from the base portion. The device includes means for positioning the second support member in any one of the plurality of positions and the second support member includes a distal end portion. The batting device includes a resilient coupling member being attachable to the second support member distal end portion. The elongate arm is releasibly attachable at one of the opposed end portions to the resilient coupling member. The device includes an elongate flexible member extending from the other end portion of the elongate flexible arm and is provided with a free end portion. A ball is attached to the free end portion of the elongate flexible member.

BRIEF DESCRIPTION OF THE DRAWINGS

The following is a description, by way of example only, of the baseball batting training device forming the present invention, reference being had to the accompanying drawings, in which.

DETAILED DESCRIPTION OF THE INVENTION

Figure 1:
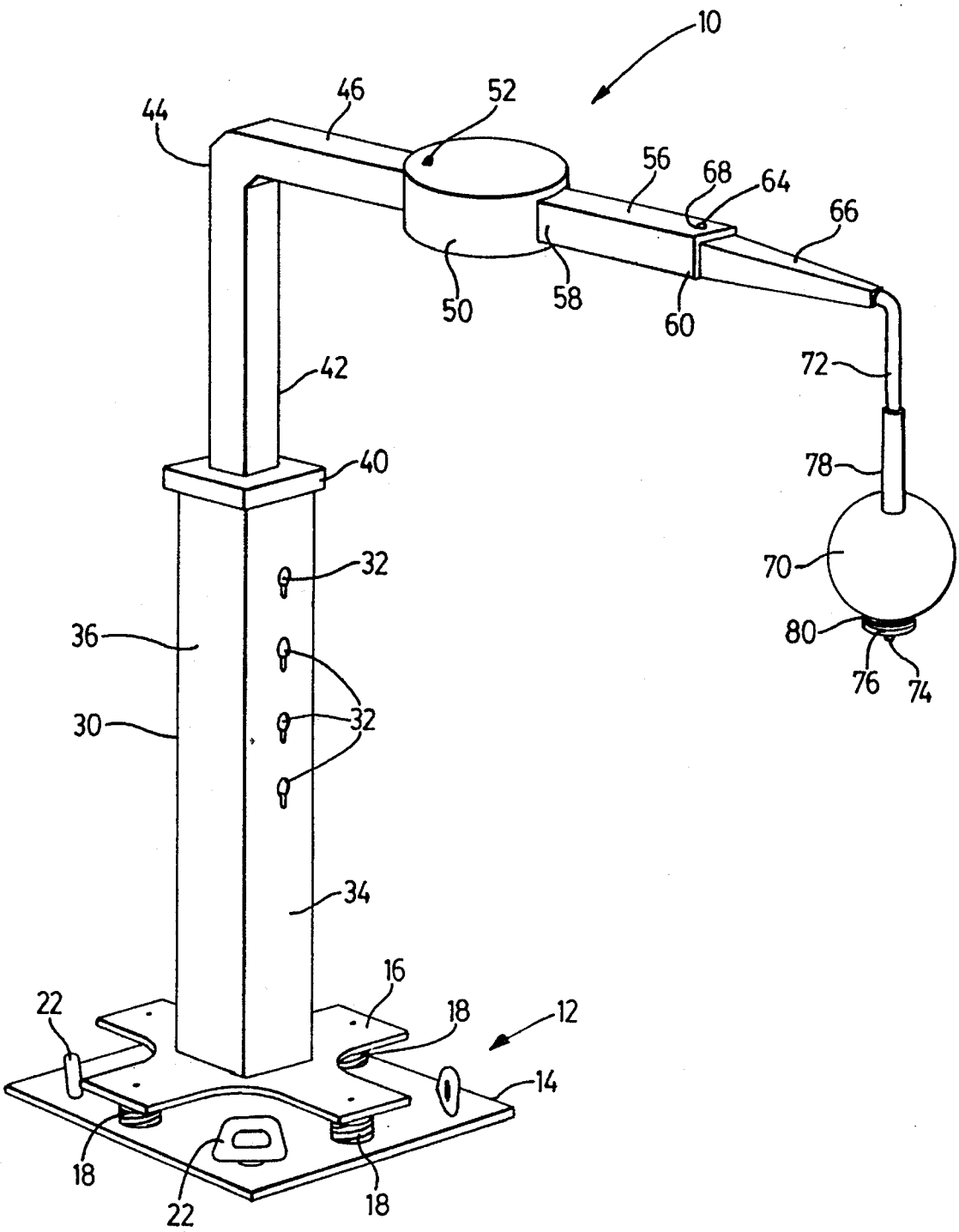
FIG. 1 is a perspective view of the baseball batting training device constructed in accordance with the present invention.
Figure 3:
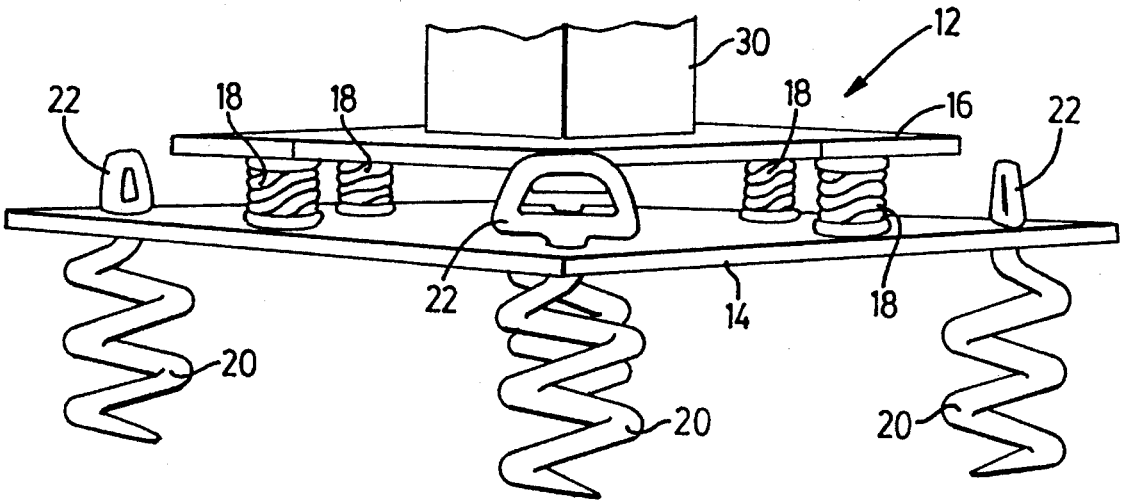
FIG. 3 is an elevational view, broken away, of the base section of the batting device of FIG. 1.
Figure 4:
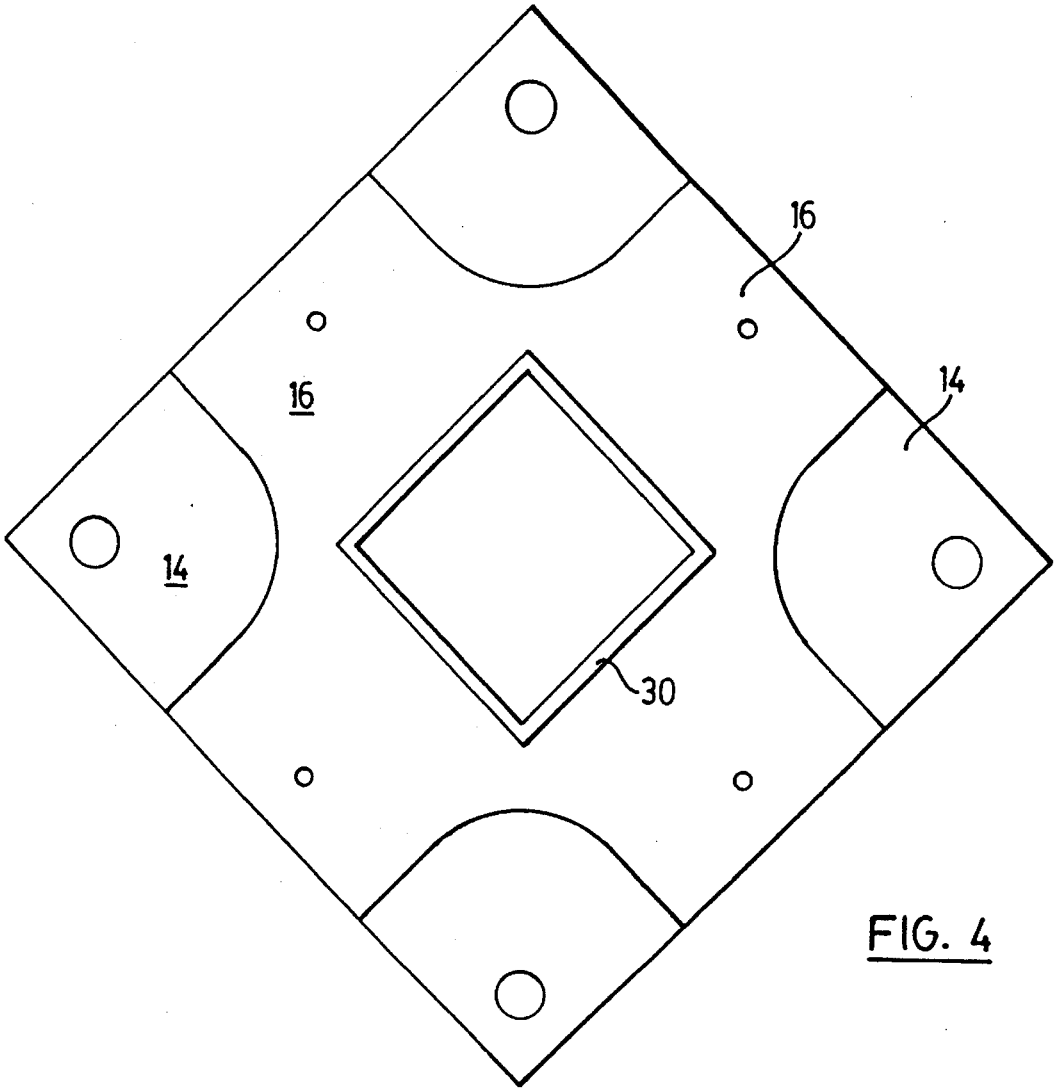
FIG. 4 is a top view of the base portion of the batting device of FIG. 1.

Referring to FIGS. 1 and 3, a baseball batting training device is shown generally at 10. Batting device 10 is provided with a base section 12 which includes a base plate 14 and a second cross-shaped plate 16 spaced above plate 14 by four rubber isolators 18 secured therebetween. Rubber isolators 18 act to damp out or minimize rotational stresses or forces from being transmitted from plate 16 to base plate 14. It will be appreciated that rubber isolators 18 could be replaced by springs or other suitable elements so long as they act to damp rotational stresses from being transmitted from plate 16 to plate 14. Four auger or corkscrew-shaped pegs 20 having handles 22 are inserted through holes in plate 14 and are used to anchor training device 10 to the ground (best seen in FIG. 3). Those skilled in the art will appreciate that numerous other ground anchoring systems may be used for anchoring the device to the ground.

Figure 2:
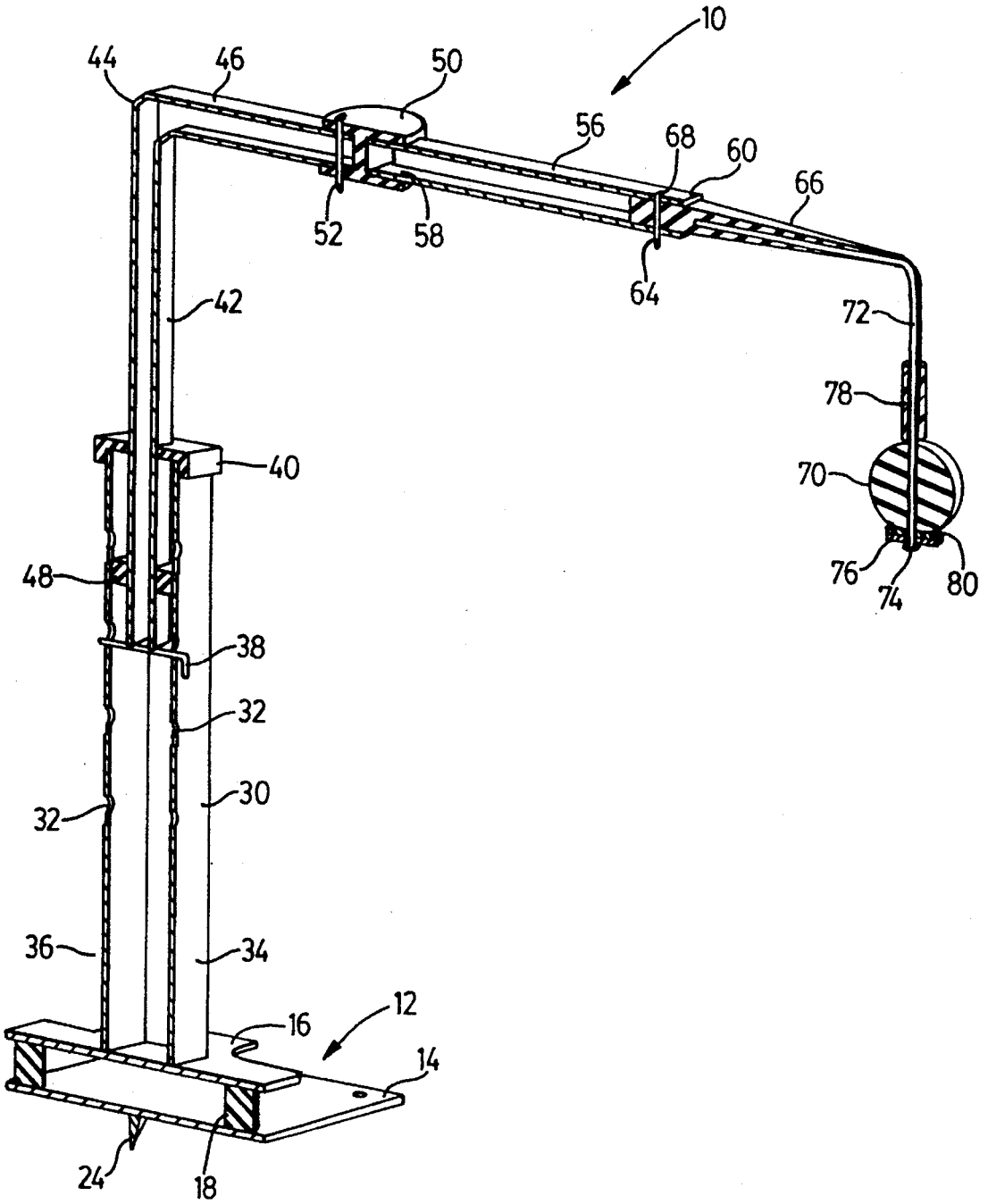
FIG. 2 is a perspective, sectional view of the training device shown in FIG. 1.

Referring specifically to FIG. 2, attached to the bottom of anchor plate 14 is a spike 24 or flat plate (not shown) to provide stability and support the batting device 10 as it is being anchored to the ground.

Referring to FIGS. 1 and 2, batting device 10 is provided with an upstanding rectangular tube 30 attached at the bottom portion to plate 16. Tube 30 is provided with opposed sides 34 and 36 and includes a plurality of pairs of spaced key-shaped holes 32 with the holes in the opposed sides being in registration. An elongate pin 38 extends through holes 32 in registration and rests in the slot portion. Mounted on the top end of tube 30 is a rubber end cap 40 adapted to fit snugly over the end of the tube. End cap 40 is provided with a rectangular aperture through which a vertical section 42 of tube 44 (of rectangular cross section) is inserted. Vertical section 42 of tube 44 slides up and down in tube 30 and glued around the outside of the lower end of section 42 is a rectangular collar 48 made of rubber or similar material. Collar 48 is sized to allow inner tube to freely move up and down within outer tube 30. Rubber end cap 40 and collar 48 act as isolators or dampeners to dampen rotational motion between inner tube section 42 and outer tube 30. Instead of rubber dampers as shown, springs or other damping devices known to those skilled in the art may be used to achieve the same result.

Tube 44 includes a horizontal section 46 which extends generally parallel to the support surface on which base plate 14 is resting. The height of section 46 above the supporting surface is adjusted by inserting pin 38 into the selected pair of registered holes 32 with the bottom of section 42 resting on the pin. The end portion of horizontal section 46 is inserted into a coupling 50 and secured thereto with a pin 52 inserted through holes in the coupling and the end of section 46. An extension arm 56 has one end 58 inserted into coupling 50 and glued or bonded therein. The other end 60 of arm 56 includes a hole 68 and a flexible arm 66 is inserted into the open end of arm 60 and secured by a pin 64 located in hole 68 and a corresponding hole through the end of arm 66. Alternatively, if extension arm 56 is not required, arm 66 may be inserted directly into coupling 50 and secured.

A ball 70 is provided with a cord 72 secured thereto by being passed through a channel through the ball. Cord 72 has and end portion 74 located on the outside of ball 70 passed through a disc-shaped rubber isolator 80 and a washer 76 and knotted to secure the washer, isolator, ball and cord together. End portion 74 is preferably permanently knotted and sealed in such a way so that it does not come lose after extended use. Washer 76 assists to even out forces transmitted when ball 70 is struck and rubber isolator 80 will absorb some of these forces. A length of plastic tubing 78 located on cord 72 between ball 70 and arm 66 provides protection for the cord.

Alternatively, end portion 74, isolator 80 and washer 76 may be moulded directly into ball 70 to form a unitary structure.

The multibraid high strength cord 72 may be securely attached to arm 66 by one of several coupling techniques. For example, the fibres of cord 72 may be chemically impregnated and moulded with rubber to form flexible arm 66. Flexible arm 66 acts as a shock absorber or dampening means as does joint 50 to absorb the forces generated when the ball is hit. Ball 70 may be fabricated of solid plastic having a weight and size corresponding to regulation size balls for hard ball, softball or any other recognized regulation ball.

Baseball batting training apparatus 10 is advantageous since it is lightweight and therefore portable. It can be readily anchored and assembled without the need for ballast to hold it in place. It can be used equally by left and right handed batters. Once apparatus 10 has been anchored in place in the ground the height of ball 70 is set by vertical adjustment of tube 44. Flexible arm 66, coupling 50, rubber end cap 40, rubber collar 48, rubber isolator 80 and rubber spacers 18 all act to damp out forces or torques generated when the ball is hit by the bat. In this way training apparatus 10 will remain securely anchored to the ground during extended periods of use. Portable prior art batting devices tend to become dislodged by rotating out of the ground during use.

Those skilled in the art will appreciate that spring dampening systems may be used in place of the resilient rubber components described above, or alternatively combinations of springs and rubber may be used.

Figure 5:
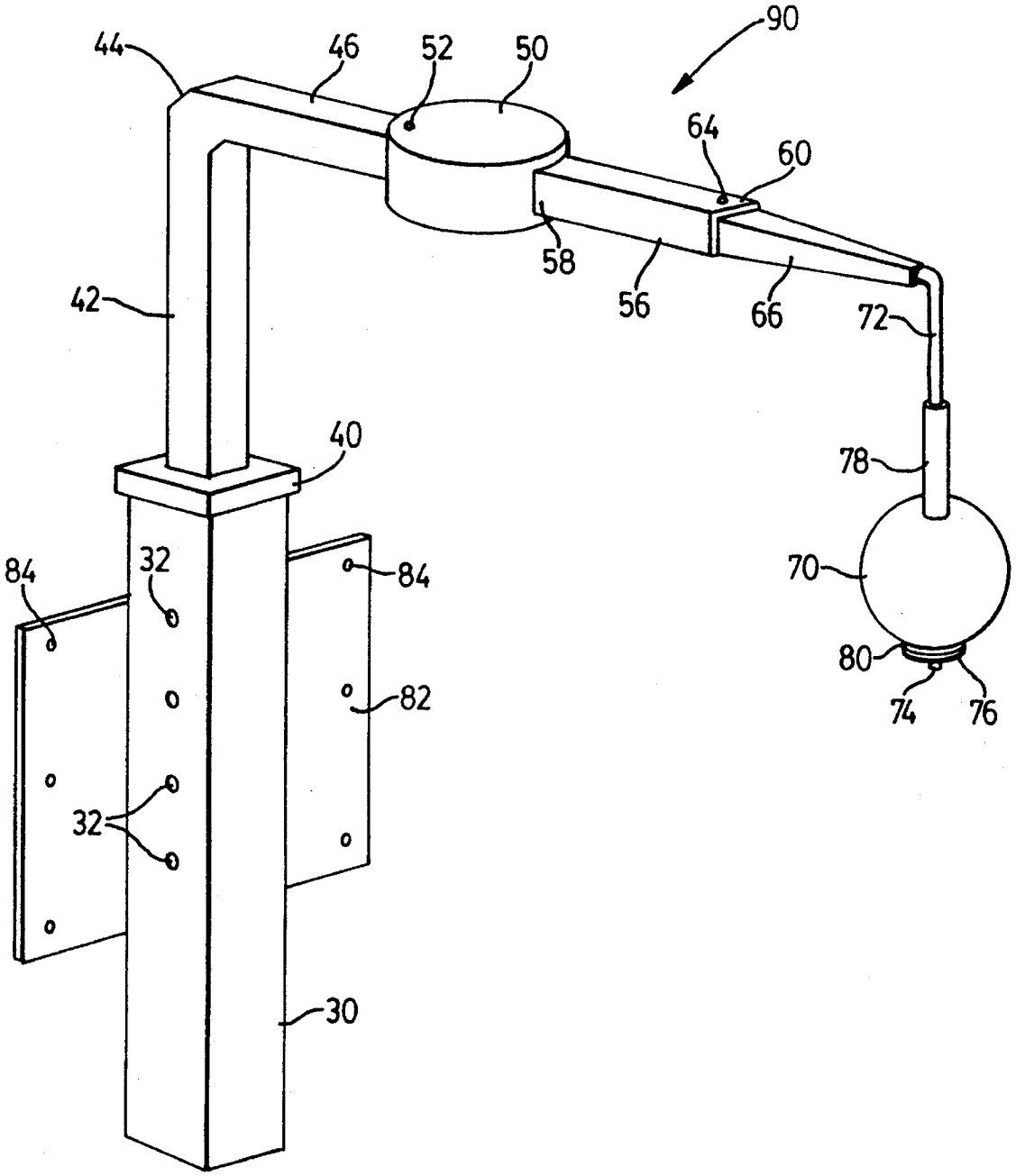
FIG. 5 is a perspective view of an alternative embodiment of a batting device constructed in accordance with the present invention.

Referring to FIG. 5, an alternative embodiment of a batting training apparatus is shown at 90 and includes a wall mounting bracket 82 rigidly secured to tube 30 and provided with a plurality of holes 84 for wall or post mounting of the training device.

Therefore, while the baseball batting training device disclosed herein has been described and illustrated with respect to the preferred embodiments, it will be appreciated that numerous variations of these embodiments may be made without departing from the scope of the invention disclosed herein.

Therefore what is claimed is:

1. A batting practise device, comprising:

a) a base portion and a first support member attached thereto, the base portion being adapted to be anchored to a surface;

b) a second support member engaging with said first support member, the second support member being movable with respect to said first support member to a plurality of positions for adjusting the distance of said second support member from said base portion, including means for retaining the second support member in any one of said plurality of positions;

c) a resilient coupling member mounted to an end portion of said second support member spaced from said first support member;

d) a flexible arm having opposite end portions, said flexible arm being mounted at one of said opposite end portions to said resilient coupling member;

e) a flexible member extending from the other end portion of said flexible arm and having a free end portion; and f) a ball attached to said free end portion of said flexible member.

2. The device according to claim 1 including damping means located between said first and second support members.

3. The device according to claim 2 including damping means interposed between said base portion and said first support member.

4. The device according to claim 3 wherein said first support member is a tube, and wherein said second support member is an L-shaped member having a first and second arm, said first arm being telescopingly movable within said tube, said resilient coupling member being attached to a free end of said second arm.

5. The device according to claim 4 including a rigid, elongate member having opposed end portions, said rigid elongate member being mounted at one of said opposed end portions to said resilient coupling member and said elongate flexible arm being mounted to said other end portion.

6. The device according to claim 2 wherein said base portion is a base plate adapted to be attached to one of either a wall and a post.

7. The device according to claim 5 wherein said base portion includes a base plate provided with a plurality of holes and including a plurality of earth engaging stakes locatable in said plurality of holes in said base plate for anchoring the plate to the ground.

* * * * *